US010806229B2

(12) United States Patent
Flemister

(10) Patent No.: US 10,806,229 B2
(45) Date of Patent: Oct. 20, 2020

(54) HAIRCLIP INCORPORATED INTO HEADGEAR

(71) Applicant: Tanya Flemister, Yuma, CO (US)

(72) Inventor: Tanya Flemister, Yuma, CO (US)

( * ) Notice: Subject to any disclaimer, the term of this patent is extended or adjusted under 35 U.S.C. 154(b) by 232 days.

(21) Appl. No.: 15/984,301

(22) Filed: May 18, 2018

(65) Prior Publication Data

US 2018/0332943 A1 Nov. 22, 2018

Related U.S. Application Data

(60) Provisional application No. 62/508,347, filed on May 18, 2017.

(51) Int. Cl.

| | |
|---|---|
| ***A45D 8/00*** | (2006.01) |
| ***A45D 8/36*** | (2006.01) |
| ***A45D 8/12*** | (2006.01) |
| *A41D 20/00* | (2006.01) |

(52) U.S. Cl.

CPC ..... *A45D 8/36* (2013.01); *A45D 8/12* (2013.01); *A41D 20/00* (2013.01); *A45D 2008/004* (2013.01)

(58) Field of Classification Search

CPC ..... A45D 8/36; A45D 8/12; A45D 2008/004; A41D 20/00; A41D 2008/004

See application file for complete search history.

(56) References Cited

U.S. PATENT DOCUMENTS

| | | | | |
|---|---|---|---|---|
| 5,493,735 | A * | 2/1996 | Rice | A41G 5/0093 2/174 |
| 5,732,720 | A * | 3/1998 | Sears | A45D 8/00 132/128 |
| 6,123,086 | A * | 9/2000 | Kuglen | A45D 8/00 132/128 |
| 7,735,495 | B2 * | 6/2010 | Lane | A45D 8/00 132/201 |
| 9,010,341 | B1 * | 4/2015 | Lee | A41G 5/0073 132/201 |
| 2008/0178902 | A1 | 7/2008 | Moeszinger | |
| 2010/0212685 | A1 | 8/2010 | Garza | |
| 2012/0216334 | A1 | 8/2012 | Brown | |

* cited by examiner

*Primary Examiner* — Steven O Douglas

(74) *Attorney, Agent, or Firm* — Ellenoff Grossman & Schole LLP; James M. Smedley; Alex Korona

(57) ABSTRACT

A device including a headband implement having a fabric with an outer surface and an inner surface, a hairclip implement configured to be operable for engagement with the headband implement, a base section of the hairclip implement configured to be encased between the outer surface and an inner surface of the headband implement, a plurality of prongs configured to slide into a hair of a user, and a tab implement operable for securing a hairclip implement to an internal surface of the headband implement.

20 Claims, 3 Drawing Sheets

HAIRCLIP INCORPORATED INTO HEADGEAR

CROSS-REFERENCE TO RELATED APPLICATIONS

The present Utility patent application claims priority benefit of the U.S. provisional application for patent Ser. No. 62/508,347 entitled "HAIRCLIP INCORPORATED INTO HEADGEAR", filed on 18 May 2017 under 35 U.S.C. 119(e). The contents of this related provisional application are incorporated herein by reference for all purposes to the extent that such subject matter is not inconsistent herewith or limiting hereof.

INCORPORATION BY REFERENCE OF SEQUENCE LISTING PROVIDED AS ATEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to hair accessories. More particularly, certain embodiments of the invention relates to functional hair accessories with integrated clips.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that there are conventional headwear with integrated retention apparatus. Such known methods may be a fabric body having a generally pentagonal shape with snap clips attached to the inside surface of the fabric, intended to protect against wind, rain, snow. etc. and easily removed once inside. They may allow for others forms of headwear, such as hats, berets and burka's, having the goal to protect hair from the elements.

By way of educational background, another aspect of the prior art generally useful to be aware of is that of the type of headbands comprised of a strip of ribbon or other fabric, long enough to go from ear to ear with snap clips attached to the inside surface of the fabric. When such clips are only secured to the fabric on the ends by rivets, hair can be caught between the fabric and the clip or in the rivets causing hair breakage or hair to be tangled causing pulling or breakage.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
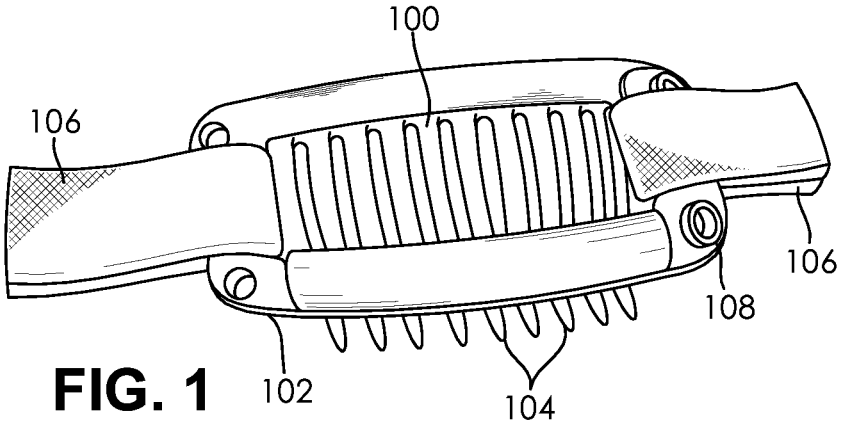
FIG. 1 illustrates a back view of an exemplary hairclip with partially obscured prongs and extending tabs for attachment to an exemplary headband in accordance with an embodiment of the present disclosure.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like.

It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms.

Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

A hair clip is provided for integration into headgear, for example a headband worn around the head as a decoration or to typically hold hair or perspiration away from the face or eyes. With the exception of prongs, the hair clip is securely positioned inside of and attached to the headband. The prongs of the hair clip protrude through a slot-like opening on a user-facing surface of the headband, securing the band to the user's head.

The location of the base of the clip (the portion of the clip other than the prongs) inside of the headband prevents the user's hair from becoming tangled around the base of the clip which would result in hair entanglement or breakage. Only the prongs make direct contact with the user's hair. The base of the clip is sewn, stitched or otherwise bound into the hairband thus preventing the clip from detaching from the hairband or moving from its intended position.

Multiple clips may be contained within a headband such that numerous points about the circumference of the user's head are contacted by the clips. This structure obviates the need for the headband to be affixed tightly around the user's head wherein the user's comfort is compromised and headache may result. The configuration of multiple clips positioned at various points around the circumference of the user's head causes the headband to remain securely in place during a variety of vigorous activities.

Tabs extend from the ends and in some embodiments from a horizontal lower edge of the clip. The tabs allow the clip to be sewn to the fabric of the headband by mechanical or manual means. The tabs also protect thread used to sew the clip to the headband from being severed as the thread is not in direct contact with the clip.

Turning to the figures, FIG. 1 illustrates a back view of the hairclip with partially obscured prongs and extending tabs for attachment to an exemplary headband in accordance with an embodiment of the present disclosure. FIG. 1 illustrates the hairclip 100 comprising a base section 102, prongs 104, tabs 106, and holes 108. The hairclip 100 may be referred to as the clip 100. The base section 102 may comprise a first edge portion, a second edge portion, a top portion and a center portion.

While only one hole 108 is labeled in FIG. 1, six total holes 108 total are provided, one hole 108 at each corner of the hairclip 100, at each corner of said first and second portions and two are obscured from view by tabs 106 on either end of the clip, at a proximate middle portion of said first and second edge portions. In an embodiment, the clip may have more or less than six holes 108. While only two prongs 104 are labeled in FIG. 1, nine total prongs 104 are provided engaged with the top portion.

In an embodiment, only the prongs 104 protrude through slot-like openings on a user-facing surface of the headband. Because components of the hairclip 100 other than the prongs 104 are inside the headband, the hair of the user is trapped and held to the band itself. Some previous implementations may provide a clip that is attached externally to a user-facing surface of a headband, a configuration that may cause the user's hair to become entangled into components of such clips other than prongs, resulting in damage to hair. The clip 100 as provided herein provides solutions to such problems.

The user's hair is protected from being entangled in the clip 100 because the base 102 is encased inside the fabric of the headband. Hair cannot be caught in the clip 100 or the headband.

The clips 100 are positioned all the way around the inside of the band to hold the headband 710 in place. Because headband 710 wraps completely around the user's head, the band's compresses against the user's head holding the user's hair in place, the clips in turn may hold the band in place. The user may open the clips 100 by pressing the center portion of the base 102, which may be encompassed in fabric but is easily felt through the fabric, away from the surface of the band 710 while holding the outer edges of the base 102 of the clip causing the prongs 104 to separate from the base 102. After the exemplary headband 710 is positioned on the head and the exposed prongs 104 slide into the hair, the clips 100 are then closed on the hair by pushing the base 102 towards the head so it will again be in contact with prongs 104, trapping the hair in the clip, therefore securing the band to the user's head. The distribution of the clips around the inside of the band may displace pressure on any one section of hair.

The view provided by FIG. 1 is of a back of the clip 100 such that the prongs 104 are underneath or on a far side of the base 102. The base of the clip 100 faces outward, i.e. away from the head of the user, and the prongs 104 face inward and contact the user's hair when the headband is worn by the user.

The tabs 106 may be used to secure the clip 100 to an internal surface of the headband. The holes 108 may also be used for this purpose.

The tabs 106 may be made of elastic. In embodiments, the tabs 106 may be made of other materials such as fabric, ribbon, rubber, silicone, plastic or any other material that can in someway be adhered to the interior of the headband.

Figure 2:
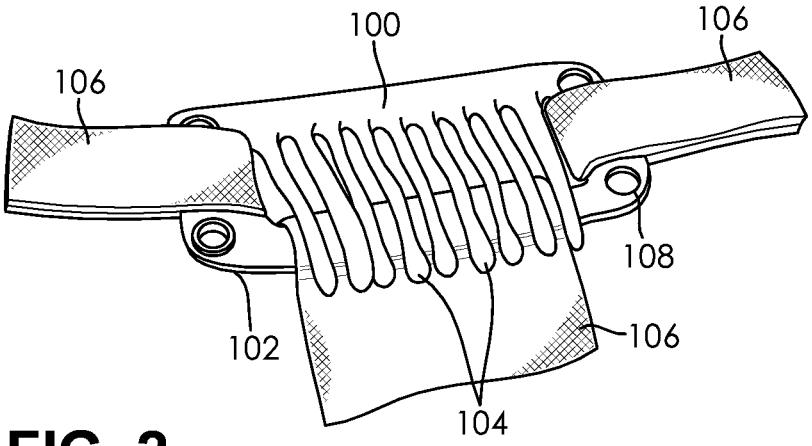
FIG. 2 illustrates a front view of an exemplary hairclip with fully visible prongs and tabs extending from the ends and bottom of the hairclip for attachment to an exemplary headband in accordance with an embodiment of the present disclosure.

FIG. 2 illustrates a front view of the hairclip 100 with fully visible prongs 104 and tabs 106 extending from the ends and bottom of the hairclip 100 for attachment to an exemplary headband in accordance with an embodiment of the present disclosure.

FIG. 2 illustrates a third tab 106 that does not appear in FIG. 1. The third tab 106 extends from a horizontal lower bar of the base 102. The third tab 106 may also be sewn to the headband to stabilize the clip 100 to supplement the attachment of the other two tabs 106 as described above for FIG. 1.

Figure 4:
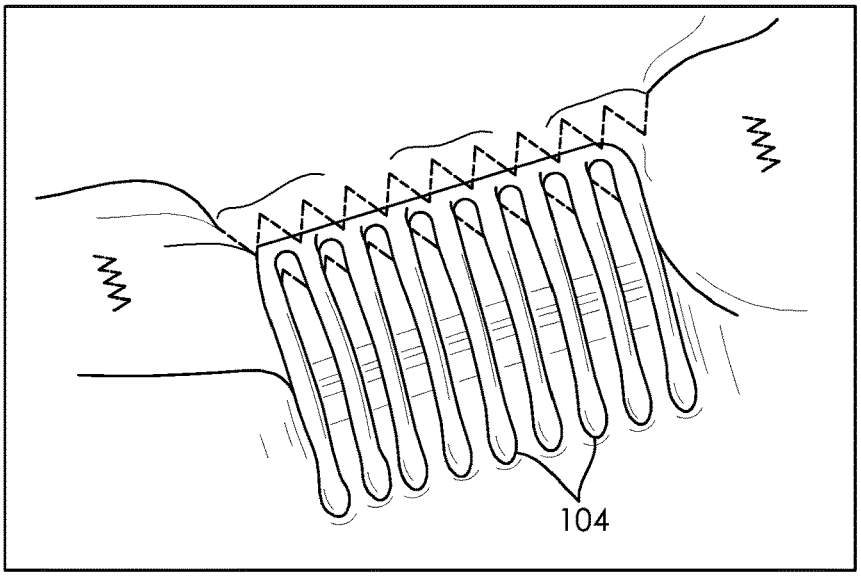
FIG. 4 illustrates a view of an exemplary hairclip with fully visible prongs only, the prongs extending from a horizontal slot-like opening in the headband in accordance with an embodiment of the present disclosure, a view that would be available to a user of the headband.

The nine prongs 104 that are depicted in FIG. 2 are in some embodiments the only part of the clip 100 that would protrude through a horizontal slot-like opening in the headband and be visible by and accessible to a user of the headband and clip 100, as is illustrated in FIG. 4. In an embodiment, the clip 100 may have more than or less than nine prongs 104. Clip 100 is an exemplary clip but future embodiments may include any clip that consists of a base that can be secured inside the band, with a protruding part or parts that can be closed on the hair to secure the headband, or other embodiments, in place.

Figure 3:
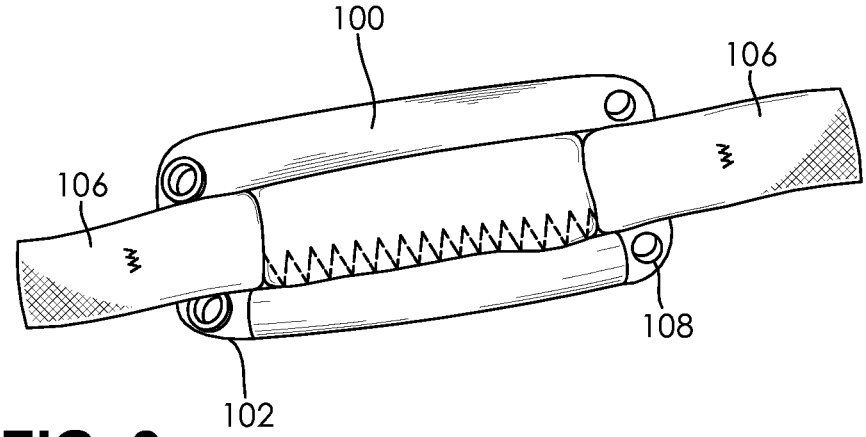
FIG. 3 illustrates a back view of an exemplary hairclip from inside the headband with fully obscured prongs and extending tabs shown for attachment to an exemplary headband in accordance with an embodiment of the present disclosure.

FIG. 3 illustrates a back view of the hairclip 100 from inside the headband with fully obscured prongs 104 and extending tabs 106 shown for attachment to an exemplary headband in accordance with an embodiment of the present disclosure. The view in FIG. 3 would not be available to a user of the headband as the portion of the clip 100 shown in FIG. 3 is in most embodiments contained and encased entirely inside the headband.

FIG. 4 illustrates a view of fully visible prongs 104 only, the prongs 104 extending from a horizontal slot-like opening in the user-facing inside surface of the headband in accordance with an embodiment of the present disclosure, a view that would be available to a user of the headband. The view of FIG. 4 is how the clip 100 is visible to the user.

Visible in FIG. 4 is stitching at the top of the prongs 104 to close the slot-like opening in user-facing inside surface of the headband. Also, somewhat visible to the right and left of the prongs 104 is stitching to attach tabs 106 to the headband wherein the tabs 106 are not visible to a user as the tabs 106 are on the internal surface of the headband.

Figure 5:
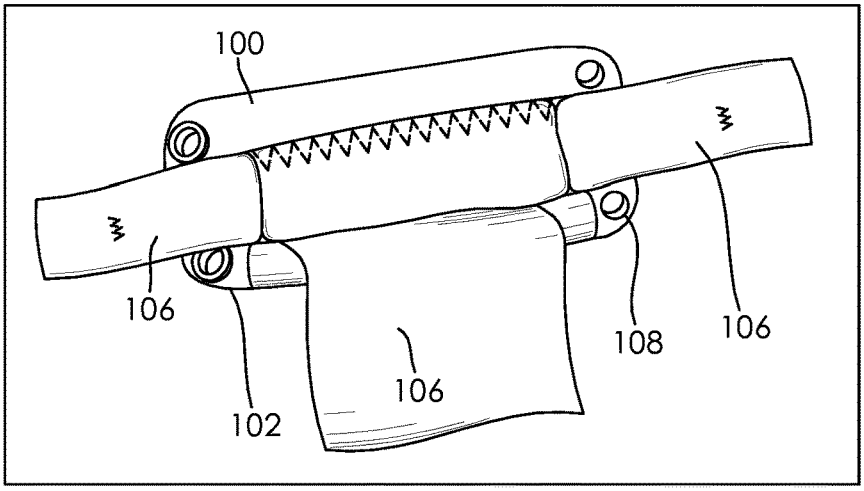
FIG. 5 illustrates a back view of an exemplary hairclip from inside the headband with fully obscured prongs and extending tabs shown for attachment to an exemplary headband in accordance with an embodiment of the present disclosure.

FIG. 5 illustrates a back view of a hairclip 100 from inside the headband with fully obscured prongs 104 and extending tabs 106 shown for attachment to an exemplary headband in accordance with an embodiment of the present disclosure. FIG. 5 is similar to FIG. 3 with an addition of a third tab 106 suspended from a horizontal lengthwise bar component of the base 102. A lower end of the third tab 106 is sewn to the headband near the ends of the prongs 104. Embodiments may include two tabs 106 attached to the ends of clip 100, one tab 106 attached to the bottom base 102 of clip 100 or all three tabs 106 attached to clip 100 for securing it to the headband.

Figure 6:
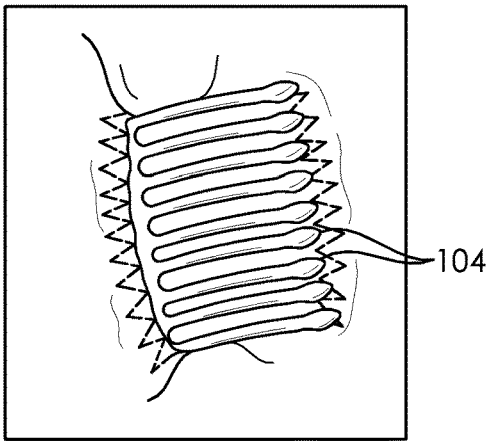
FIG. 6 illustrates a view of an exemplary hairclip with fully visible prongs only, the prongs extending from a horizontal slot-like opening in a headband in accordance with an embodiment of the present disclosure, a view that would be available to a user of the headband.

FIG. 6 illustrates a view of an exemplary hairclip with fully visible prongs only, the prongs 104 extending from a horizontal slot-like opening in a user-facing inside surface the headband in accordance with an embodiment of the present disclosure, a view that would be available to a user of the headband. FIG. 6 illustrates stitching in addition to the stitching illustrated in FIG. 4. The additional stitching, near the ends of the prongs 104, may attach to the tab 106 shown in FIG. 5 that extends below the base 102.

Figure 7:
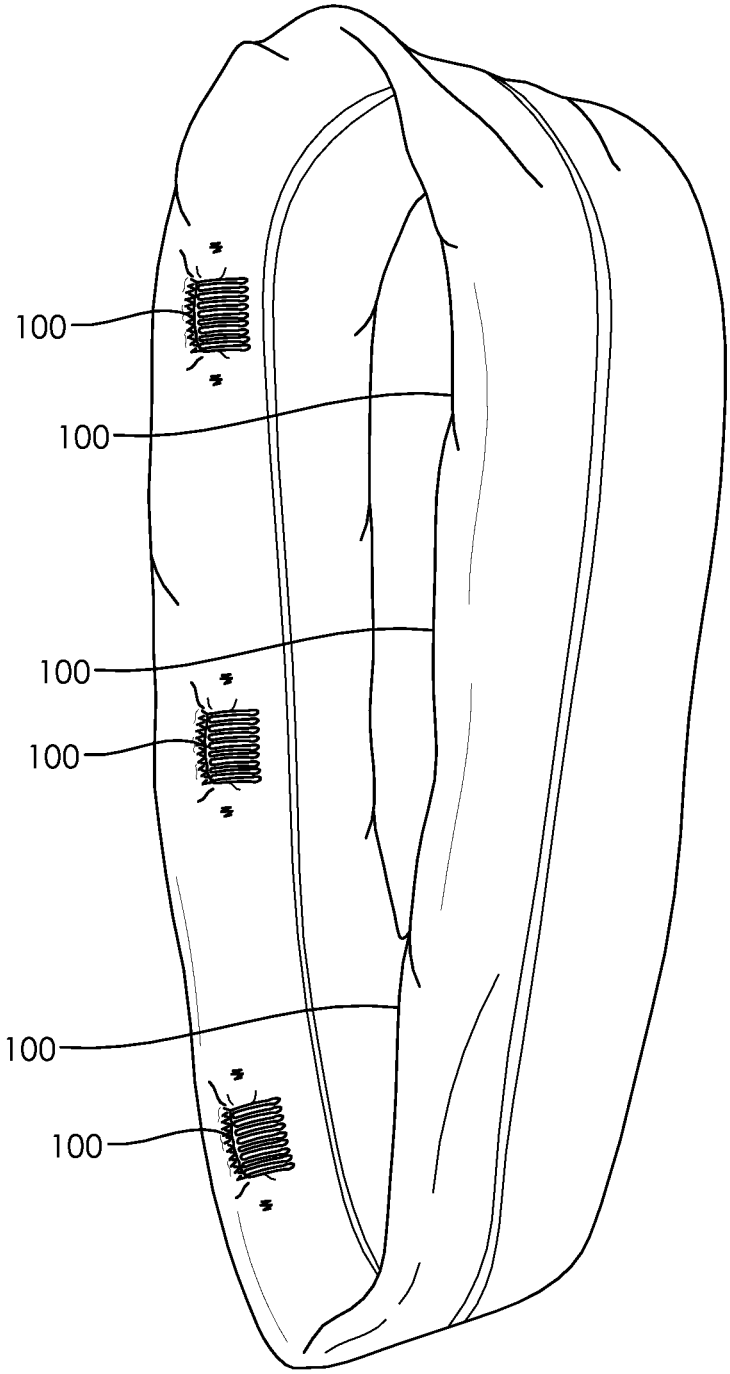
FIG. 7 illustrates a headband in accordance with an embodiment of the present disclosure with a view of three exemplary hairclips with fully visible prongs only, the prongs extending from a horizontal slot-like opening in the interior surface of the headband. Three additional hairclips are obscured from view by the outside of the headband.

FIG. 7 illustrates a view of three exemplary hairclips 100 with fully visible prongs 104 only, the prongs 104 extending from a horizontal slot-like opening in a depicted headband 710 in accordance with an embodiment of the present disclosure, a view that would be available to a user of the headband 710. In an embodiment, a user of the headband 710 would stretch headband 710 around the user's head so that the clips are in contact with the hair and position it approximately 1 inch behind the hair line on top of the head, behind the ears and down around the base of the scalp. The prongs 104 would attach to the user's hair as described herein.

The headband in FIG. 7 is shown for illustration and discussion purposes only. While FIG. 7 depicts an exemplary headband with three visible hairclip 100 and three clips 100 obscured from view on the other half of the headband, in an embodiment the headband 710 includes more than or less than six of hairclip 100.

The slot-like hole in the headband 710 may be sealed by stitching, melting the fabric, gluing or by any other means of securing the hole so it does not stretch or become misshapen or so that the fabric does not fray. The clip 100 may be held in place by sewing or stitching the tabs 106 or hole 108 as described above or it may be glued, attached by rivets or any other means of attachment.

While the headband 710 has been used as an example of headgear into which one or more of hairclip 100 may be embedded as described herein, in embodiments other types of headgear may be used. Hats, berets, burkas, scarves, bandanas, beanies, turbans, and yarmulkes/kippot are examples of such headgear.

Such headgear may also include "do-rags." A do-rag (also spelled variously as a doo-rag, dew-rag, du-rag or durag), is a piece of cloth used to cover the top of the user's head. The do-rag is sometimes made of nylon material and has a "skullcap" fit. The do-rag may also be referred to as a "wavecap." The headband 710 may be stretchable or non-stretchable. The headband 710 may be made from at least one of polyester, spandex, cotton, silk, wool, lace, elastic, chiffon, and other materials.

The invention has been described above by way of illustration, and the specific embodiments disclosed are not intended to limit the invention to the particular forms disclosed.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing functional hair accessories with integrated clips according to the present invention will be apparent to those skilled in the art. Various aspects of the invention have been described above by way of illustration, and the specific embodiments disclosed are not intended to limit the invention to the particular forms disclosed. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a headband implement, in which said headband implement comprises a fabric having an outer surface and an inner surface;

a hairclip implement, wherein said hairclip implement is configured to be operable for engagement with said headband implement;

a base section of said hairclip implement, wherein said base section is configured to be encased between said outer surface and an inner surface of said headband implement;

a plurality of prongs, wherein said plurality of prongs is configured to slide into a hair of a user; and a tab implement, wherein said tab implement is operable for securing said hairclip implement to an internal surface of said headband implement.

2. The device of claim 1, further comprising a plurality of hole portions being disposed at each corner of said hairclip implement.

3. The device of claim 2, in which said plurality of hole portions comprises at least six or more hole portions, wherein said at least six or more hole portions are operable for attaching said base section to said headband implement by at least one of, sewing, stitching, gluing, and attaching by rivets.

4. The device of claim 3, further comprising at least one or more slot segments being disposed around a circumference of said inner surface of said headband implement.

5. The device of claim 4, in which said hairclip implement comprises a plurality of hairclips disposed at each slot segment of said headband implement.

6. The device of claim 5, wherein said encased base section is sewn or stitched into said fabric of said headband implement to prevent said hairclip implement from detaching from said headband implement.

7. The device of claim 6, wherein said plurality of hairclips is configured to secure said headband implement on a user's head.

8. The device of claim 6, wherein said plurality of prongs of each of said plurality of hairclips is configured to protrude through each of said slot segment.

9. The device of claim 6, in which said base section comprises a first edge portion, a second edge portion, a top portion and a center portion.

10. The device of claim 9, in which said tab implement comprises a first tab engaged with said first edge portion of said base section.

11. The device of claim 10, in which said tab implement further comprises a second tab engaged with said second edge portion of said base section.

12. The device of claim 11, in which said tab implement comprises a third tab engaged with said center portion of said base section.

13. The device of claim 12, in which said plurality of prongs are disposed on said top portion of said base section.

14. The device of claim 3, in which said headband implement further comprises at least one of, an elastic fabric and a stretchable fabric made from a polyester, a nylon, a spandex, a cotton, a silk, a wool, a lace, or a chiffon.

15. A device comprising:

a headband implement, in which said headband implement comprises a fabric having an outer surface and an inner surface;

a hairclip implement, wherein said hairclip implement is configured to be operable for engagement with said headband implement;

a base section of said hairclip implement, wherein said base section is configured to be encased between said outer surface and an inner surface of said headband implement, in which said base section comprises a first edge portion, a second edge portion, a top portion and a center portion;

a plurality of prongs disposed on said top portion, wherein said plurality of prongs is configured to slide into a hair of a user;

a tab implement, wherein said tab implement is operable for securing said hairclip implement to an internal surface of said headband implement;

a plurality of hole portions being disposed at each corner of said hairclip implement, wherein said at least six or more hole portions are operable for attaching said base section to said headband implement by at least one of, sewing, stitching, gluing, and attaching by rivets.

16. The device of claim 15, further comprising at least one or more slot segments being disposed around the circumference of said inner surface of said headband implement, in which said hairclip implement comprises a plurality of hairclips disposed at each slot segment.

17. The device of claim 16, wherein said encased base section is sewn or stitched into said fabric of said headband implement to prevent said hairclip implement from detaching from said headband implement, wherein said plurality of prongs of each of said plurality of hairclips is configured to protrude through each of said slot segment.

18. The device of claim 17, in which said tab implement comprises:

a first tab, wherein said first tab is configured to engage with said first edge portion of said base section;

a second tab, wherein said second tab is configured to engage with said second edge portion of said base section; and a third tab, wherein said third tab is configured to engage with said center portion of said base section.

19. The device of claim 18, in which said headband implement further comprises at least one of, an elastic fabric and a stretchable fabric made from a polyester, a nylon, a spandex, a cotton, a silk, a wool, a lace, or a chiffon.

20. A device comprising:

a headgear implement configured to be worn around a head of a user, in which said headgear implement comprises a fabric having an outer surface and an inner surface;

a hairclip implement, wherein said hairclip implement is configured to be operable for engagement with said headgear implement;

a base section of said hairclip implement, wherein said base section is configured to be encased between said outer surface and an inner surface of said headgear implement;

a plurality of prongs, wherein said plurality of prongs is configured to slide into a hair or a user; and a tab implement, wherein said tab implement is operable for securing said hairclip implement to an internal surface of said headgear implement.

* * * * *